US007332992B2

(12) United States Patent
Iwai

(10) Patent No.: US 7,332,992 B2
(45) Date of Patent: Feb. 19, 2008

(54) TRANSFORMER

(75) Inventor: Kenji Iwai, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/726,658

(22) Filed: Mar. 22, 2007

(65) Prior Publication Data

US 2007/0236321 A1 Oct. 11, 2007

(30) Foreign Application Priority Data

Apr. 7, 2006 (JP) ..... P2006-106105

(51) Int. Cl.
*H01F 27/28* (2006.01)

(52) U.S. Cl. ..... 336/170; 336/214

(58) Field of Classification Search ..... 336/65, 336/83, 170, 180–186, 212–215, 220–222
See application file for complete search history.

(56) References Cited

U.S. PATENT DOCUMENTS 3,413,580 A * 11/1968 Gibas ..... 335/279
4,099,066 A * 7/1978 Beggs ..... 307/419
5,177,460 A * 1/1993 Dhyanchand et al. ..... 336/12
6,348,848 B1 * 2/2002 Herbert ..... 336/178
6,822,546 B1 * 11/2004 Jakab et al. ..... 336/178
6,873,237 B2 * 3/2005 Chandrasekaran et al. .... 336/83
6,909,352 B2 * 6/2005 Hobson et al. ..... 336/178

FOREIGN PATENT DOCUMENTS

JP 2002-367837 7/2004

* cited by examiner

*Primary Examiner*—Tuyen T. Nguyen
(74) *Attorney, Agent, or Firm*—Robert J. Depke; Rockey, Depke & Lyons, LLC.

(57) ABSTRACT

Disclosed herein is a transformer including: an iron core; and a winding wound around the iron core; wherein the iron core includes a column-shaped output side iron core part, a plurality of column-shaped input side iron core parts, and a connecting iron core part, the winding includes a plurality of primary windings, a secondary winding, and generated magnetic fluxes.

5 Claims, 9 Drawing Sheets

TRANSFORMER

CROSS REFERENCES TO RELATED APPLICATIONS

The present invention contains subject matter related to Japanese Patent Application JP 2006-106105 filed in the Japan Patent Office on Apr. 7, 2006, the entire contents of which being incorporated herein by reference.

BACKGROUND OF THE INVENTION

1. Field of the Invention

The present invention relates to a transformer.

2. Description of the Related Art

In related art, a high-voltage generating transformer is provided in which a pair of a primary winding and a secondary winding and a rectifier circuit are integrated with each other. An output voltage of the transformer is determined by an input voltage and a turns ratio between the primary winding and the secondary winding.

Hence, in order to obtain a high-voltage power when the input voltage on the primary side is low, a high turns ratio is necessary, so that the number of turns of the primary winding is decreased and the number of turns of the secondary winding is increased.

However, since the number of turns of the primary winding may not be made smaller than one, when a turns ratio of 1,000 is necessary, for example, the number of turns of the secondary winding is 1,000 or larger. In practice, the number of turns of the primary winding is larger than one, and therefore the number of turns of the secondary winding is much larger.

An increase in the number of turns of the secondary winding involves an increase in distributed capacitance within the winding, and a loss becomes greater as frequency of operation is increased.

Proposed to avoid this are a constitution in which a secondary winding is divided into a large number of secondary windings to form a multilayer winding (layer winding), rectifiers are respectively connected to the divided secondary windings, and the rectifiers are connected in series with each other to obtain a high voltage, and a constitution in which a voltage multiplier rectifier circuit is used as a rectifier circuit.

However, such constitutions invite an increase in size of the transformer and an increase in the number of parts of the rectifier circuit, and are thus disadvantageous in reducing size and cost and securing reliability.

In addition, a transformer is proposed in which a primary winding is divided into a plurality of primary windings for a single secondary winding, and the plurality of primary windings are connected in parallel with each other to thereby obtain a high-current output while achieving miniaturization (see Japanese Patent Laid-Open No. 2002-367837).

SUMMARY OF THE INVENTION

However, in the structure of the transformer having the above-described plurality of primary windings connected in parallel with each other, the primary windings are not independent of each other and are simply divided from each other. The primary windings generate only one magnetic flux and thus have the same function as one primary winding, and an output voltage may not be raised.

The present invention has been made in view of such a situation, and it is desirable to provide a transformer that can provide a high voltage and is advantageous in achieving reductions in size and cost.

According to an embodiment of the present invention, there is provided a transformer including: an iron core; and a winding wound around the iron core; wherein the iron core includes a column-shaped output side iron core part, a plurality of column-shaped input side iron core parts situated in a vicinity of the output side iron core part, and a connecting iron core part configured to connect both ends in a direction of length of the plurality of input side iron core parts to both ends in a direction of length of the output side iron core part, the winding includes a plurality of primary windings respectively wound around the plurality of input side iron core parts, a secondary winding wound around the output side iron core part, and generated magnetic fluxes generated in the respective input side iron core parts by the respective primary windings independently pass through the output side iron core part via the connecting iron core part, whereby a total of a plurality of the generated magnetic fluxes intersect the secondary winding.

In the transformer according to the embodiment of the present invention, generated magnetic fluxes generated in the respective input side iron core parts by the plurality of primary windings independently pass through the output side iron core part via the connecting iron core part, whereby a total of the generated magnetic fluxes of the respective primary windings intersect the secondary winding. It is therefore possible to obtain a higher output voltage as compared with an existing transformer, and reduce the number of turns of the secondary winding. Thus, the transformer according to the embodiment of the present invention is advantageous in reducing size and cost while obtaining a high voltage.

DETAILED DESCRIPTION OF THE PREFERRED EMBODIMENTS

First Embodiment

A first embodiment of the present invention will next be described with reference to the drawings.

Figure 1:
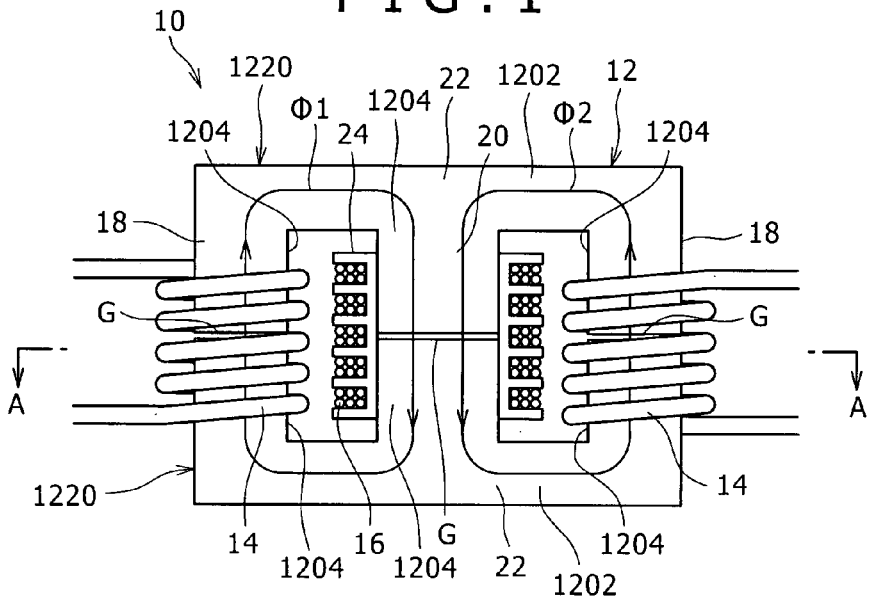
FIG. 1 is a front view of a transformer according to a first embodiment.
Figure 2:
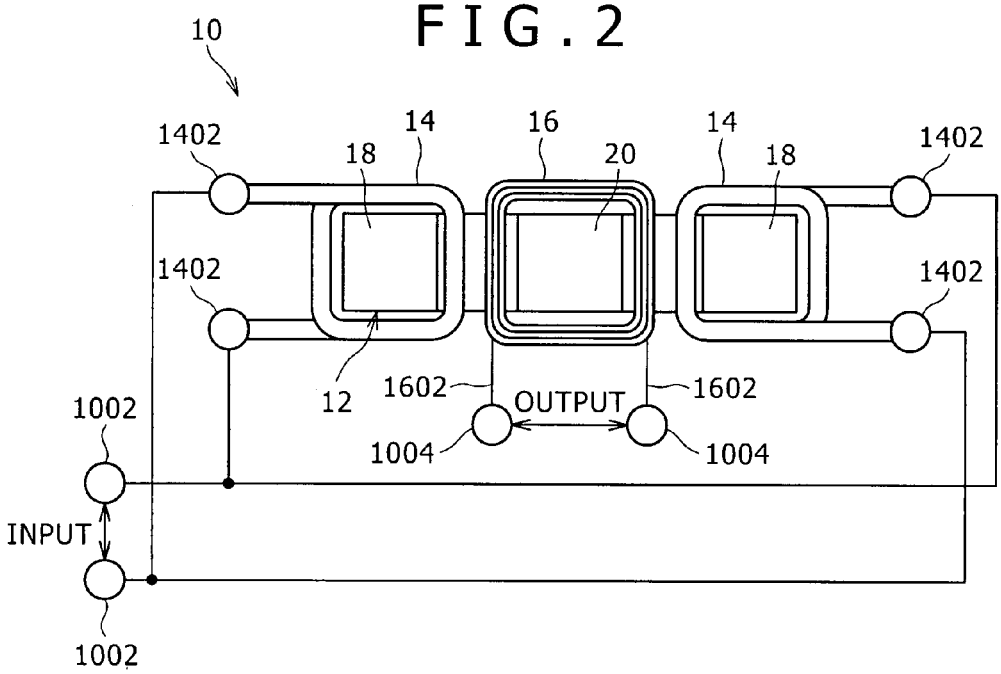
FIG. 2 is a sectional view taken along a line A-A of FIG. 1.

FIG. 1 is a front view of a transformer 10 according to the present embodiment. FIG. 2 is a sectional view taken along a line A-A of FIG. 1.

As shown in FIG. 1 and FIG. 2, the transformer 10 has an iron core 12 (core), primary windings 14, and a secondary winding 16.

The iron core 12 has a column-shaped output side iron core part 20, a plurality of column-shaped input side iron core parts 18 situated in the vicinity of the output side iron core part 20, and a connecting iron core part 22 for connecting both ends in a direction of length of the plurality of column-shaped input side iron core parts 18 to both ends in a direction of length of the output side iron core part 20.

The present embodiment is provided with two input side iron core parts 18 and one output side iron core part 20. The input side iron core parts 18 and the output side iron core part 20 are disposed in parallel with each other. The two input side iron core parts 18 and the one output side iron core part 20 are provided in the shape of extending straight lines arranged in a direction orthogonal to the direction of length of the iron core parts. The two input side iron core parts 18 are disposed such that the output side iron core part 20 is interposed between the input side iron core parts 18.

In the present embodiment, the iron core 12 is formed by joining together two divided bodies 1220 having an E-shape as viewed from the front, the divided bodies 1220 being of the same shape and the same size.

As shown in FIG. 1, each of the divided bodies 1220 is formed by a straight line part 1202 having a rectangular shape in section and extending in the form of a straight line and three column bodies 1204 that are erected in a same direction orthogonal to an extending direction of the straight line part 1202 from both ends and a center in the extending direction of the straight line part 1202, have a rectangular shape in section, and have a same height.

The two divided bodies 1220 are joined to each other with ends of the column bodies 1204 of the two divided bodies 1220 opposed to each other and with a core gap G interposed between the ends of the column bodies 1204.

Thus, of the three column bodies 1204 of each divided body 1220, two column bodies 1204 at both ends in the direction of length of the straight line part 1202 form the two input side iron core parts 18, respectively, and the central column body 1204 forms the output side iron core part 20. The straight line part 1202 forms the connecting iron core part 22.

The iron core 12 is formed by a soft magnetic material. As such a soft magnetic material, a known material in the past such for example as a silicon steel plate, a permalloy, or ferrite can be used.

The primary windings 14 are wound around the plurality of input side iron core parts 18, respectively. In the present embodiment, the primary windings 14 are wound around the two input side iron core parts 18. The number of turns of each primary winding 14 is N1.

Both ends 1402 of each primary winding 14 are connected to input terminals 1002 of the transformer 10 in parallel with each other.

The secondary winding 16 is wound around the output side iron core part 20 via a bobbin 24 having a plurality of grooves. The number of turns of the secondary winding 16 is N2.

Both ends 1602 of the secondary winding 16 are connected to output terminals 1004 of the transformer 10.

The action and effect of the transformer 10 will next be described.

When an input voltage V1 is supplied to the input terminals 1002, the two primary windings 14 generate independent magnetic fluxes $\phi 1$ and $\phi 2$ (generated magnetic fluxes $\phi 1$ and $\phi 2$) in the respective input side iron core parts 18, and these magnetic fluxes $\phi 1$ and $\phi 2$ pass through the output side iron core part 20 via the connecting iron core part 22, whereby a total of the magnetic fluxes $\phi 1$ and $\phi 2$ intersect the secondary winding 16. Thus an output voltage V2 of the secondary winding 16 is based on the magnetic flux $\phi 1+\phi 2$.

The output voltage V2 of the secondary winding 16 is proportional to an amount of magnetic flux intersecting the secondary winding 16. In the transformer 10 according to the present embodiment, since the two primary windings 14 whose number of turns is N1 are provided, the magnetic flux intersecting the secondary winding 16 is twice that of an existing transformer provided with one primary winding 14 whose number of turns is N1, so that an output voltage twice that of the existing transformer can be obtained. In other words, the number of turns of the secondary winding 16 can be halved as compared with the existing transformer.

Hence, the transformer 10 according to the present embodiment is advantageous in reducing size and cost while obtaining high voltage.

In addition, since the number of turns of the secondary winding 16 can be reduced, it is possible to reduce a capacitive component occurring within the secondary winding 16, and reduce energy unnecessarily consumed by the capacitive component. The transformer 10 according to the present embodiment is therefore advantageous in improving electrical characteristics and securing reliability of the transformer 10.

Description will next be made of a first concrete example using the transformer 10 according to the first embodiment in a power supply circuit.

Figure 3:
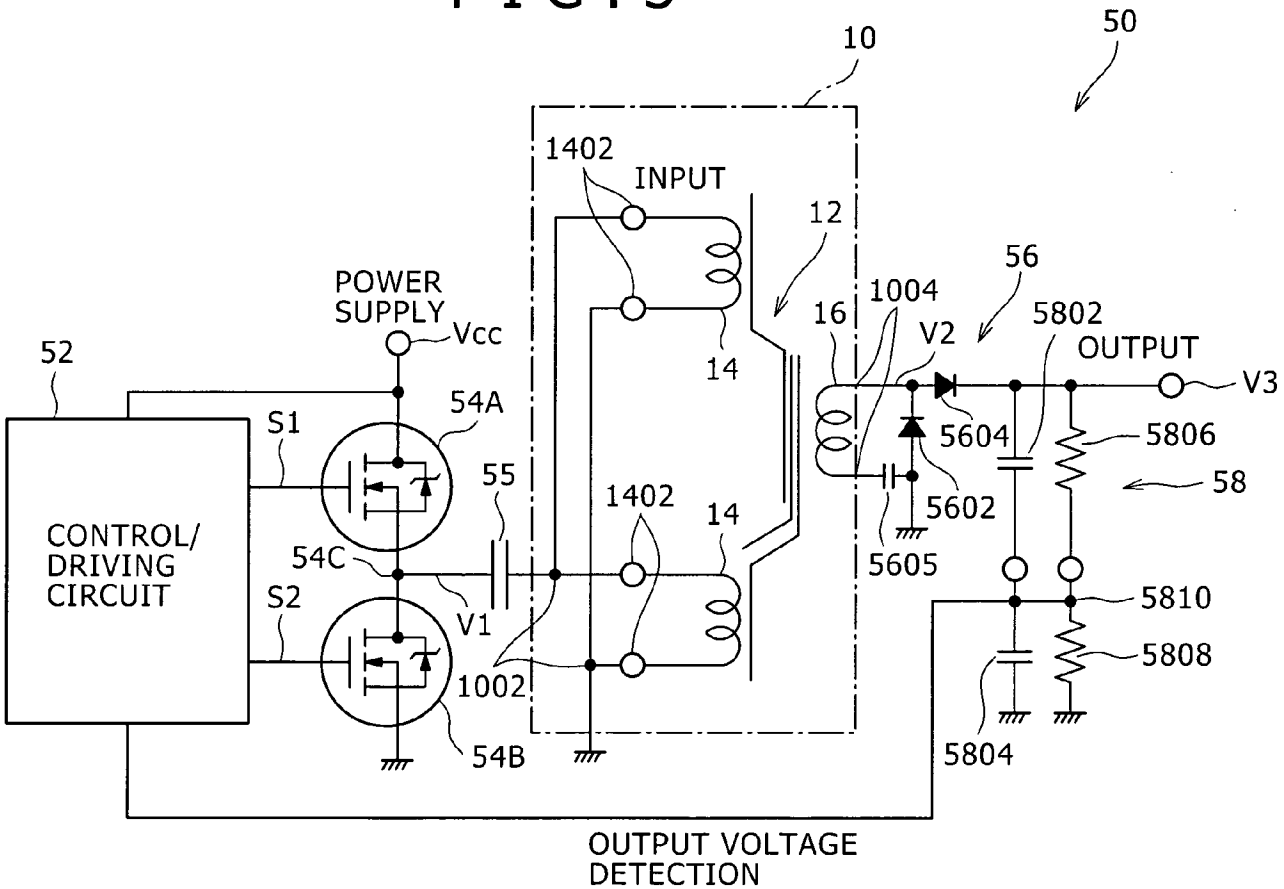
FIG. 3 is a circuit diagram of a power supply circuit using the transformer.

FIG. 3 is a circuit diagram of a power supply circuit 50 using the transformer 10.

The power supply circuit 50 in the present example is used as a high-voltage power supply such for example as a power supply for driving a field emission display (FED).

The power supply circuit 50 includes the transformer 10, a control/driving circuit 52, a first switching element 54A, a second switching element 54B, a capacitor 55, a rectifier circuit 56, a smoothing and output voltage detecting circuit 58, and the like.

The control/driving circuit 52 is supplied with a power Vcc, and outputs a first rectangular wave S1 and a second rectangular wave S2. The first rectangular wave S1 and the second rectangular wave S2 have a duty ratio of 50% or lower, and are out of phase with each other by 180 degrees.

One terminal of the first switching element 54A is connected to the power Vcc. Another terminal of the first switching element 54A and one terminal of the second switching element 54B are connected to a common output terminal 54C. Another terminal of the second switching element is connected to a ground.

The first switching element 54A is supplied with one rectangular wave S1 and thereby performs on-off operation. The second switching element 54B is supplied with the other rectangular wave S2 and thereby performs on-off operation.

The output terminal 54C is connected to one input terminal 1002 of the transformer 10 via the capacitor 55. The other input terminal 1002 of the transformer 10 is connected to the ground.

The output terminals 1004 of the transformer 10 are connected to the rectifier circuit 56.

The rectifier circuit 56 is formed by a first diode 5602, a second diode 5604 and a capacitor 5605.

The first diode 5602 has a cathode connected to one output terminal 1004 of the transformer 10, and has an anode connected to the ground and connected to the other output terminal 1004 via the capacitor 5605.

An anode of the second diode 5604 is connected to the cathode of the first diode 5602, and a cathode of the second diode 5604 forms an output terminal of the rectifier circuit 56.

The smoothing and output voltage detecting circuit 58 is formed by a first capacitor 5802, a second capacitor 5804 connected in series with each other between the output terminal of the rectifier circuit 56 and the ground, a first resistance 5806 and a second resistance 5808 connected in series with each other between the output terminal of the rectifier circuit 56 and the ground.

Further, a point of connection between the first capacitor 5802 and the second capacitor 5804 and a point of connection between the first resistance 5806 and the second resistance 5808 are connected to a common point of connection 5810. The common point of connection 5810 is connected to the control/driving circuit 52.

The operation of the power supply circuit 50 will be described.

The control/driving circuit 52 operates to make the first switching element 54A and the second switching element 54B alternately perform the on-off operation. An alternating voltage is thereby generated at the output terminal 54C, and supplied as input voltage V1 to the input terminals 1002 of the transformer 10 via the capacitor 55.

Each of the primary windings 14 of the transformer 10 is supplied with the alternating voltage V1, whereby the transformer 10 outputs a stepped-up output voltage V2 from the secondary winding 16.

The output voltage V2 is rectified by the rectifier circuit 56, smoothed by the smoothing circuit 58, and then output as direct-current output voltage V3.

A voltage appearing at the common point of connection 5810 results from dividing the output voltage V3 by the resistances 5806 and 5808. The control/driving circuit 52 adjusts the duty ratio (pulse width) of the first rectangular wave S1 and the second rectangular wave S2 on the basis of the divided voltage so that the output voltage V3 has a predetermined value, whereby feedback control is performed.

In the present example, the power supply voltage Vcc is about 3.5 V as output voltage of a battery, for example. The first rectangular wave S1 and the second rectangular wave S2 have a frequency of 60 kHz to 120 kHz. The output voltage V3 is about 10 kV (3 mA).

As described above, the transformer 10 according to the present embodiment can be used in the power supply circuit 50 functioning as a high-voltage power supply. By reducing size and cost of the transformer 10, the transformer 10 is advantageous in reducing size and cost of the power supply circuit 50 and an electronic device including such a power supply circuit 50. The transformer 10 is particularly advantageous in reducing size and weight of a portable electronic device operating on a low-voltage power supply such as a battery or the like.

Second Embodiment

A second embodiment will next be described.

The second embodiment is different from the first embodiment in that the second embodiment has three primary windings 14 and three input side iron core parts 18.

Figure 4:
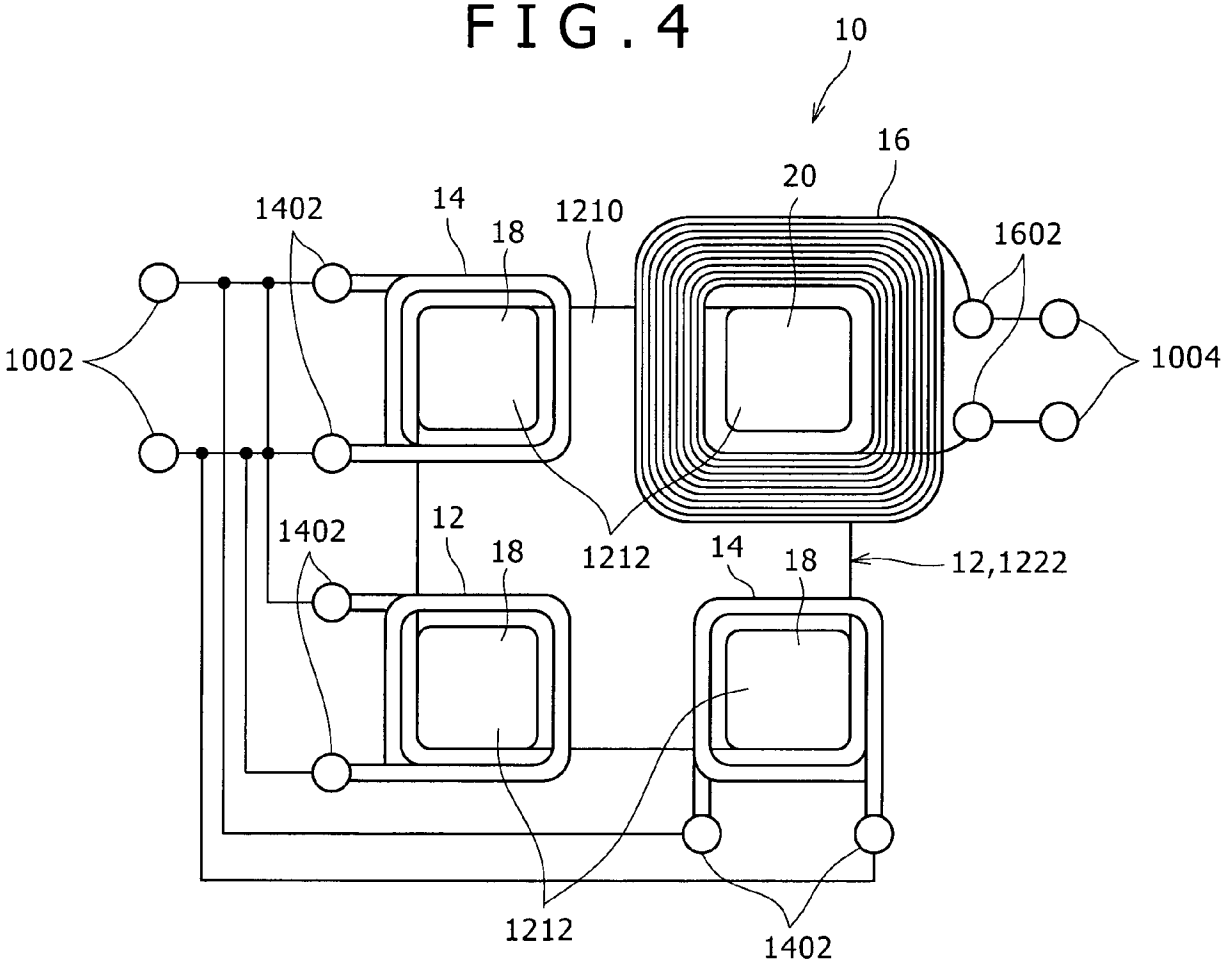
FIG. 4 is a sectional view of a transformer according to a second embodiment.
Figure 5:
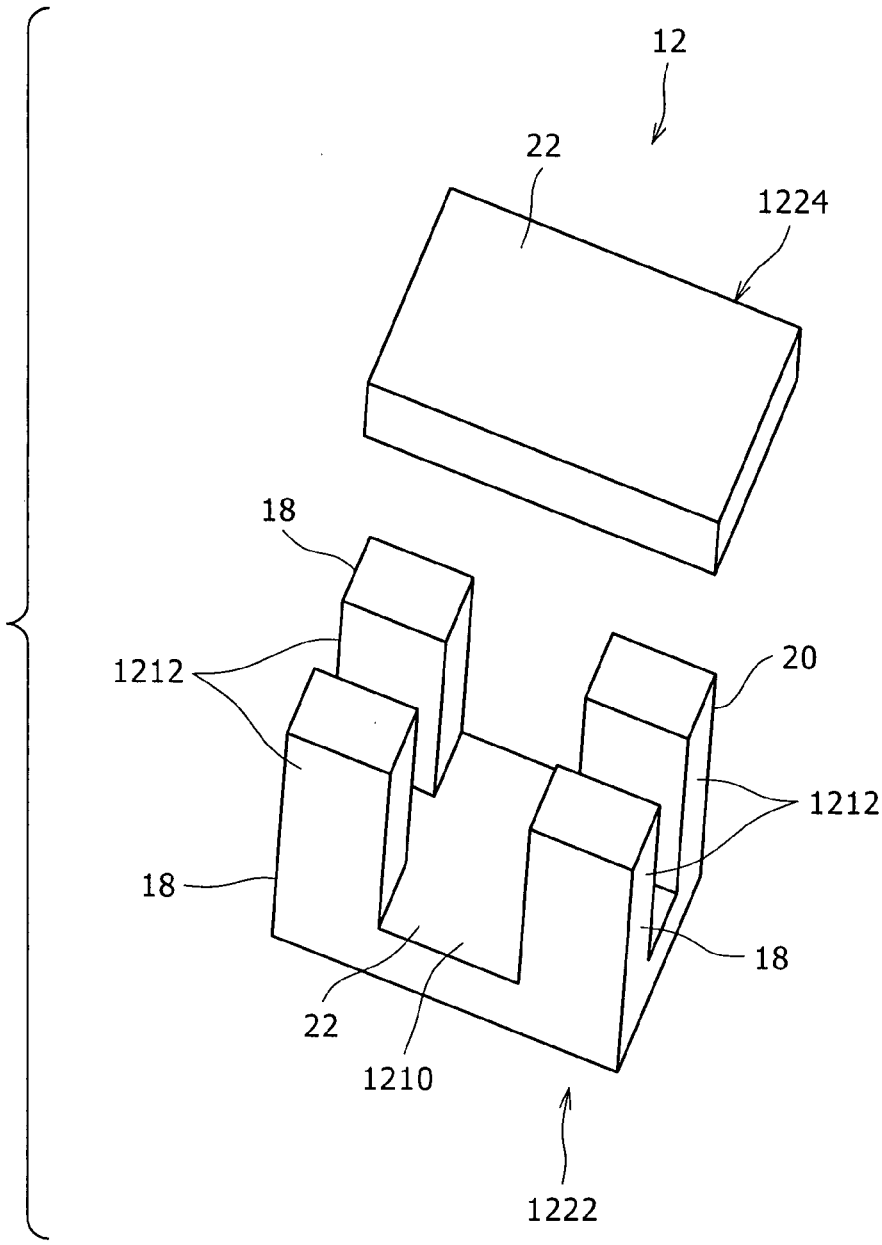
FIG. 5 is an exploded perspective view showing a structure of an iron core of the transformer according to the second embodiment.

FIG. 4 is a sectional view of a transformer 10 according to the second embodiment. FIG. 5 is an exploded perspective view showing a structure of an iron core 12 of the transformer 10 according to the second embodiment.

Incidentally, in the embodiment to be described below, identical or similar parts and members to those of the first embodiment are identified by the same reference numerals.

As shown in FIGS. 4 and 5, the iron core 12 in the transformer 10 according to the second embodiment has one output side iron core part 20, three input side iron core parts 18 situated in the vicinity of the output side iron core part 20, and a connecting iron core part 22 for connecting both ends in a direction of length of the three input side iron core parts 18 to both ends in a direction of length of the output side iron core part 20.

The three input side iron core parts 18 and the output side iron core part 20 are disposed in parallel with each other. The three input side iron core parts 18 are provided around the output side iron core part 20.

In the second embodiment, as shown in FIG. 5, the iron core 12 is formed by joining together a first divided body 1222 and a second divided body 1224.

The first divided body 1222 is formed by a plate part 1210 in the form of a rectangular plate and four column bodies 1212 that are erected from four corner parts on an upper surface of the plate part 1210, have a rectangular shape in section, and have a same height.

The second divided body 1224 is formed in the same shape of a rectangular plate as the plate part 1210.

The first divided body 1222 and the second divided body 1224 are joined to each other such that ends of the four column bodies 1212 of the first divided body 1222 are in contact with the second divided body 1224.

Thus, of the four column bodies 1212 of the first divided body 1222, three column bodies 1212 form the three input side iron core parts 18, respectively, and the one remaining column body 1212 forms the output side iron core part 20. The second divided body 1224 and the plate part 1210 form the connecting iron core part 22.

While the above description has been made of a case where the second divided body 1224 is used, it is possible to form the iron core 12 by halving the height of the four column bodies 1212 of the first divided body 1222 and using two such first divided bodies 1222.

As in the first embodiment, the iron core 12 is formed by a soft magnetic material.

The primary windings 14 are wound around the three input side iron core parts 18, respectively. The number of turns of each primary winding 14 is N1.

As in the first embodiment, both ends 1402 of each primary winding 14 are connected to input terminals 1002 of the transformer 10 in parallel with each other.

A secondary winding 16 is wound around the output side iron core part 20. The number of turns of the secondary winding 16 is N2.

As in the first embodiment, both ends 1602 of the secondary winding 16 are connected to output terminals 1004 of the transformer 10.

The action and effect of the transformer 10 will next be described.

When an input voltage V1 is supplied to the input terminals 1002, the three primary windings 14 generate independent magnetic fluxes $\phi 1$, $\phi 2$, and $\phi 3$ (generated magnetic fluxes $\phi 1$, $\phi 2$, and $\phi 3$) in the respective input side iron core parts 18, and these magnetic fluxes $\phi 1$, $\phi 2$, and $\phi 3$ pass through the output side iron core part 20 via the connecting iron core part 22, whereby a total of the magnetic fluxes $\phi 1$, $\phi 2$, and $\phi 3$ intersect the secondary winding 16.

Thus an output voltage V2 of the secondary winding 16 is based on the magnetic flux $\phi 1+\phi 2+\phi 3$.

The output voltage V2 of the secondary winding 16 is proportional to an amount of magnetic flux intersecting the secondary winding 16. In the transformer 10 according to the present embodiment, since the three primary windings 14 whose number of turns is N1 are provided, the magnetic flux intersecting the secondary winding 16 is three times that of an existing transformer provided with one primary winding 14 whose number of turns is N1, so that an output voltage three times that of the existing transformer can be obtained. In other words, the number of turns of the secondary winding 16 can be reduced to ⅓ of that of the existing transformer.

Hence, the transformer 10 according to the second embodiment has the action and effect of the first embodiment, of course, and with the three primary windings 14 and the three input side iron core parts 18, the transformer 10 according to the second embodiment is more advantageous than the first embodiment in reducing size and cost while obtaining high voltage. In addition, since the number of turns of the secondary winding 16 can be further reduced, the transformer 10 according to the second embodiment is more advantageous in improving electrical characteristics and securing reliability of the transformer 10.

Description will next be made of a second concrete example using the transformer 10 according to the second embodiment in a power supply circuit.

Figure 6:
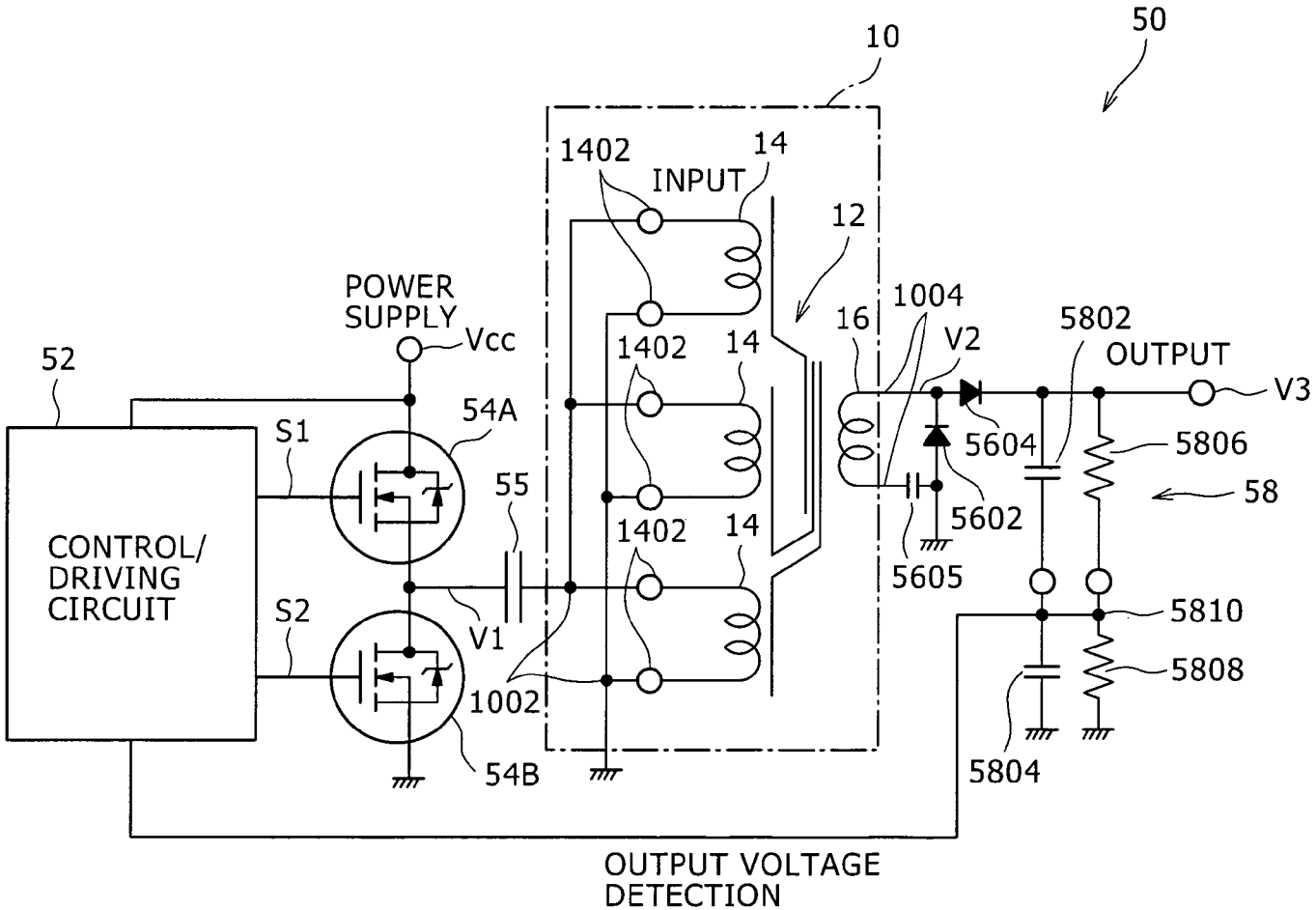
FIG. 6 is a circuit diagram of a power supply circuit using the transformer.

FIG. 6 is a circuit diagram of a power supply circuit 50 using the transformer 10.

In the present example, the transformer 10 of the power supply circuit 50 in the first concrete example shown in FIG. 3 is replaced with the transformer 10 according to the second embodiment, and configurations other than the transformer 10 are the same as in FIG. 3.

The power supply circuit 50 of FIG. 6 performs the same operation as the power supply circuit 50 in the first concrete example, of course, and with the three primary windings 14 and the three input side iron core parts 18, the transformer 10 can be further reduced in size and cost as compared with the first embodiment. The transformer 10 according to the second embodiment is thus more advantageous in reducing size and cost of the power supply circuit 50 and an electronic device including such a power supply circuit 50, and is particularly more advantageous in reducing size and weight of a portable electronic device.

Third Embodiment

A third embodiment will next be described.

The third embodiment is different from the first embodiment in that the third embodiment has four primary windings 14 and four input side iron core parts 18.

Figure 7:
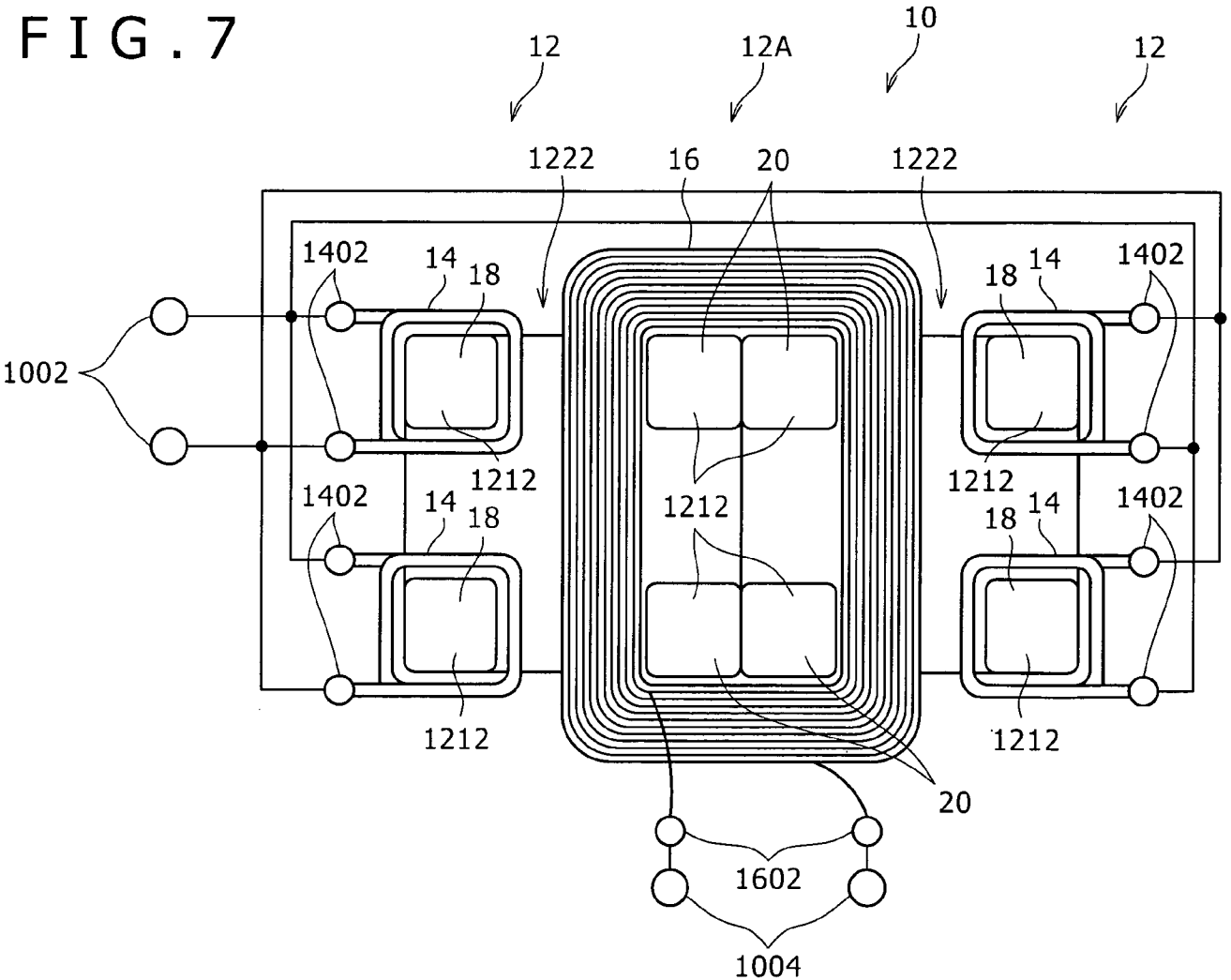
FIG. 7 is a sectional view of a transformer according to a third embodiment.

FIG. 7 is a sectional view of a transformer 10 according to the third embodiment.

An iron core 12A in the transformer 10 according to the third embodiment has an output side iron core part 20, four input side iron core parts 18 situated in the vicinity of the output side iron core part 20, and a connecting iron core part 22 for connecting both ends in a direction of length of the four input side iron core parts 18 to both ends in a direction of length of the output side iron core part 20.

The four input side iron core parts 18 and the output side iron core part 20 are disposed in parallel with each other. The four input side iron core parts 18 are provided around the output side iron core part 20.

The primary windings 14 are wound around the four input side iron core parts 18, respectively. The number of turns of each primary winding 14 is N1.

As in the first embodiment, both ends 1402 of each primary winding 14 are connected to input terminals 1002 of the transformer 10 in parallel with each other.

A secondary winding 16 is wound around the output side iron core part 20. The number of turns of the secondary winding 16 is N2.

As in the first embodiment, both ends 1602 of the secondary winding 16 are connected to output terminals 1004 of the transformer 10.

The iron core 12A according to the third embodiment uses two iron cores 12 according to the second embodiment that are joined to each other with one side of the plate part 1210 of one iron core 12 in contact with one side of the plate part 1210 of the other iron core 12.

Hence, of eight column bodies 1212 of two first divided bodies 1222, four column bodies 1212 situated on outer sides in a direction in which the two iron cores 12 are arranged form the four input side iron core parts 18, respectively, and the four remaining column bodies 1212 situated on inner sides in the direction in which the two iron cores 12 are arranged form the single output side iron core part 20. Second divided bodies 1224 and plate parts 1210 form the connecting iron core part 22.

As in the first embodiment, the iron cores 12 are formed by a soft magnetic material.

The action and effect of the transformer 10 will next be described.

When an input voltage V1 is supplied to the input terminals 1002, the four primary windings 14 generate independent magnetic fluxes $\phi 1$, $\phi 2$, $\phi 3$, and $\phi 4$ (generated magnetic fluxes $\phi 1$, $\phi 2$, $\phi 3$, and $\phi 4$) in the respective input side iron core parts 18, and these magnetic fluxes $\phi 1$, $\phi 2$, $\phi 3$, and $\phi 4$ pass through the output side iron core part 20 via the connecting iron core part 22, whereby a total of the magnetic fluxes $\phi 1$, $\phi 2$, $\phi 3$, and $\phi 4$ intersect the secondary winding 16. Thus an output voltage V2 of the secondary winding 16 is based on the magnetic flux $\phi 1+\phi 2+\phi 3+\phi 4$.

The output voltage V2 of the secondary winding 16 is proportional to an amount of magnetic flux intersecting the secondary winding 16. In the transformer 10 according to the third embodiment, since the four primary windings 14 whose number of turns is N1 are provided, the magnetic flux intersecting the secondary winding 16 is four times that of an existing transformer provided with one primary winding 14 whose number of turns is N1, and therefore an output voltage four times that of the existing transformer can be obtained. In other words, the number of turns of the secondary winding 16 can be reduced to ¼ of that of the existing transformer.

Hence, the transformer 10 according to the third embodiment has the action and effect of the first embodiment, of course, and with the four primary windings 14 and the four input side iron core parts 18, the transformer 10 according to the third embodiment is even more advantageous than the second embodiment in reducing size and cost while obtaining high voltage. In addition, since the number of turns of the secondary winding 16 can be further reduced, the transformer 10 according to the third embodiment is even more advantageous in improving electrical characteristics and securing reliability of the transformer 10.

Fourth Embodiment

A fourth embodiment will next be described.

The fourth embodiment is different from the first embodiment in that the fourth embodiment has six primary windings 14 and six input side iron core parts 18.

Figure 8:
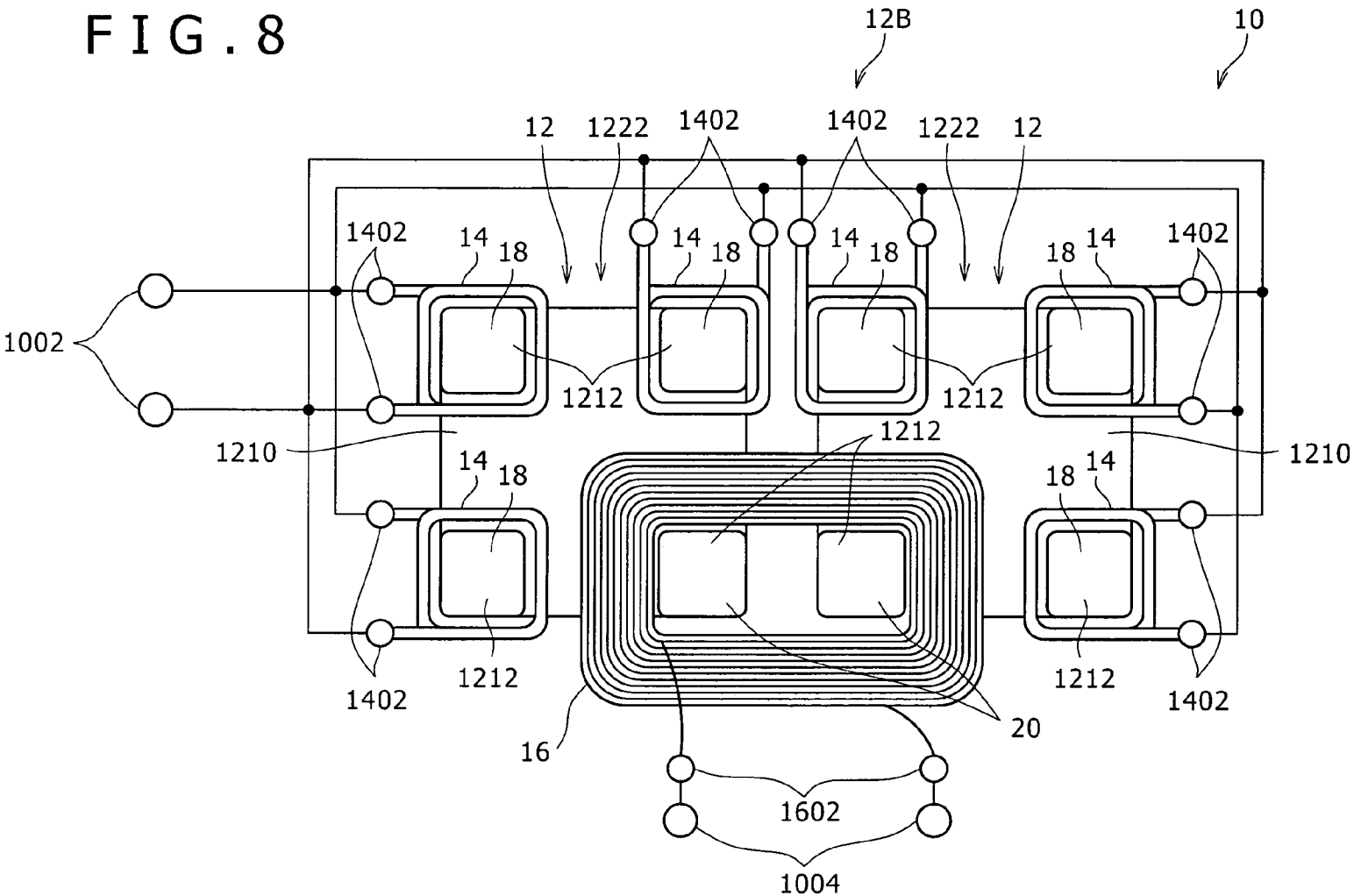
FIG. 8 is a sectional view of a transformer according to a fourth embodiment.

FIG. 8 is a sectional view of a transformer 10 according to the fourth embodiment.

An iron core 12B in the transformer 10 according to the fourth embodiment has an output side iron core part 20, six input side iron core parts 18 situated in the vicinity of the output side iron core part 20, and a connecting iron core part 22 for connecting both ends in a direction of length of the six input side iron core parts 18 to both ends in a direction of length of the output side iron core part 20.

The six input side iron core parts 18 and the output side iron core part 20 are disposed in parallel with each other. The six input side iron core parts 18 are provided around the output side iron core part 20.

The primary windings 14 are wound around the six input side iron core parts 18, respectively. The number of turns of each primary winding 14 is N1.

As in the first embodiment, both ends 1402 of each primary winding 14 are connected to input terminals 1002 of the transformer 10 in parallel with each other.

A secondary winding 16 is wound around the output side iron core part 20. The number of turns of the secondary winding 16 is N2.

As in the first embodiment, both ends 1602 of the secondary winding 16 are connected to output terminals 1004 of the transformer 10.

The iron core 12B according to the fourth embodiment uses two iron cores 12 according to the second embodiment that are disposed such that one side of the plate part 1210 of one iron core 12 is adjacent to one side of the plate part 1210 of the other iron core 12.

Hence, by arranging two first divided bodies 1222 as described above, two rows each including four column bodies 1212 arranged therein are provided. The four column bodies 1212 in one row and two column bodies 1212 at both ends of the other row form the input side iron core parts 18, respectively. Two central column bodies 1212 in the other row form the single output side iron core part 20. Second divided bodies 1224 and plate parts 1210 form the connecting iron core part 22.

As in the first embodiment, the iron cores 12 are formed by a soft magnetic material.

The action and effect of the transformer 10 will next be described.

When an input voltage V1 is supplied to the input terminals 1002, the six primary windings 14 generate independent magnetic fluxes $\phi 1$, $\phi 2$, $\phi 3$, $\phi 4$, $\phi 5$, and $\phi 6$ (generated magnetic fluxes $\phi 1$, $\phi 2$, $\phi 3$, $\phi 4$, $\phi 5$, and $\phi 6$) in the respective input side iron core parts 18, and these magnetic fluxes $\phi 1$, $\phi 2$, $\phi 3$, $\phi 4$, $\phi 5$, and $\phi 6$ pass through the output side iron core part 20 via the connecting iron core part 22, whereby a total of the magnetic fluxes $\phi 1$, $\phi 2$, $\phi 3$, $\phi 4$, $\phi 5$, and $\phi 6$ intersect the secondary winding 16. Thus an output voltage V2 of the secondary winding 16 is based on the magnetic flux $\phi 1+\phi 2+\phi 3+\phi 4+\phi 5+\phi 6$.

The output voltage V2 of the secondary winding 16 is proportional to an amount of magnetic flux intersecting the secondary winding 16. In the transformer 10 according to the fourth embodiment, since the six primary windings 14 whose number of turns is N1 are provided, the magnetic flux intersecting the secondary winding 16 is six times that of an existing transformer provided with one primary winding 14 whose number of turns is N1, and therefore an output voltage six times that of the existing transformer can be obtained. In other words, the number of turns of the secondary winding 16 can be reduced to ⅙ of that of the existing transformer.

Hence, the transformer 10 according to the fourth embodiment has the action and effect of the first embodiment, of course, and with the six primary windings 14 and the six input side iron core parts 18, the transformer 10 according to the fourth embodiment is even more advantageous than the third embodiment in reducing size and cost while obtaining high voltage. In addition, since the number of turns of the secondary winding 16 can be further reduced, the transformer 10 according to the fourth embodiment is even more advantageous in improving electrical characteristics and securing reliability of the transformer 10.

Fifth Embodiment

A fifth embodiment will next be described.

The fifth embodiment is different from the first embodiment in that the fifth embodiment has four primary windings 14 and four input side iron core parts 18.

Figure 9:
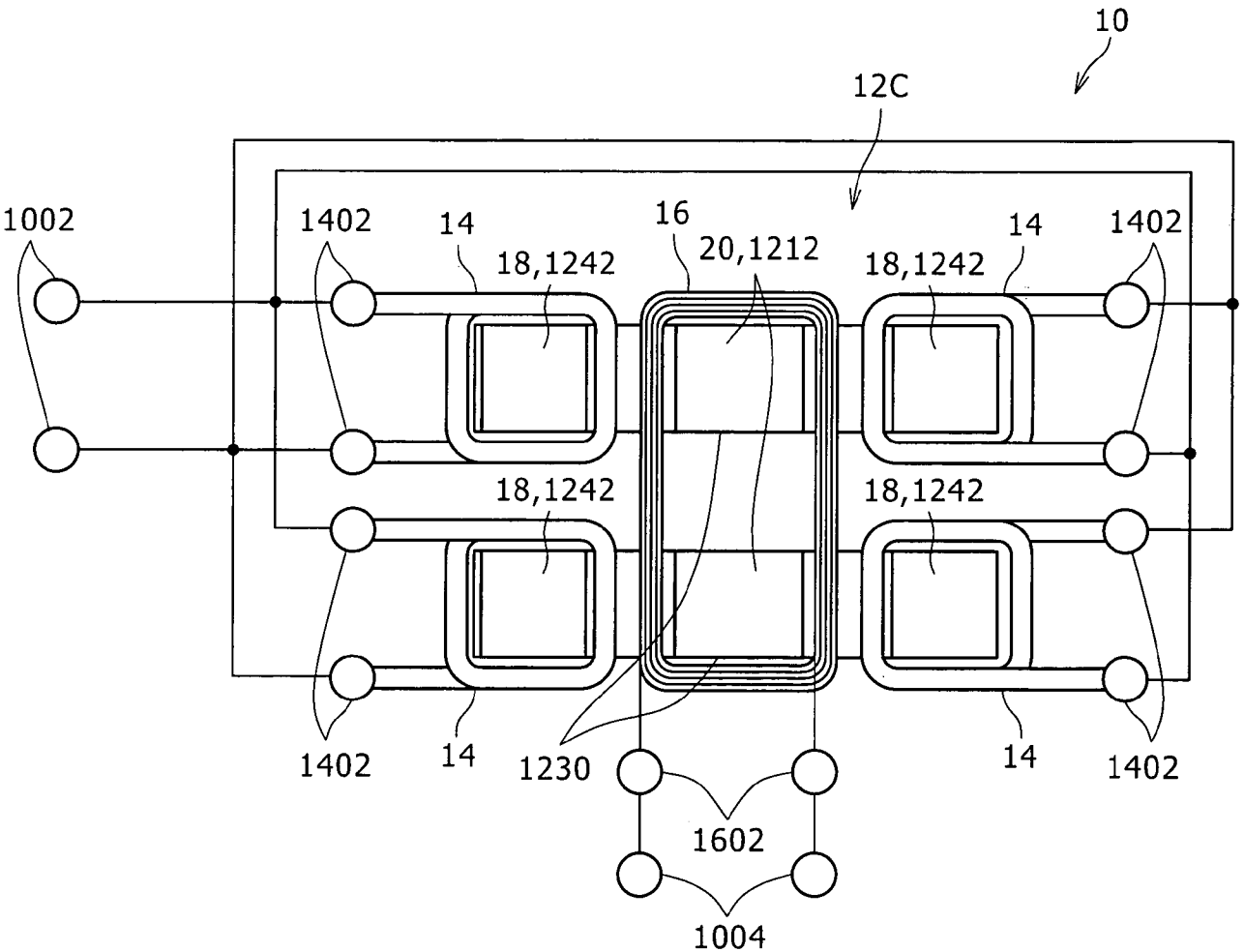
FIG. 9 is a sectional view of a transformer according to a fifth embodiment.
Figure 10:
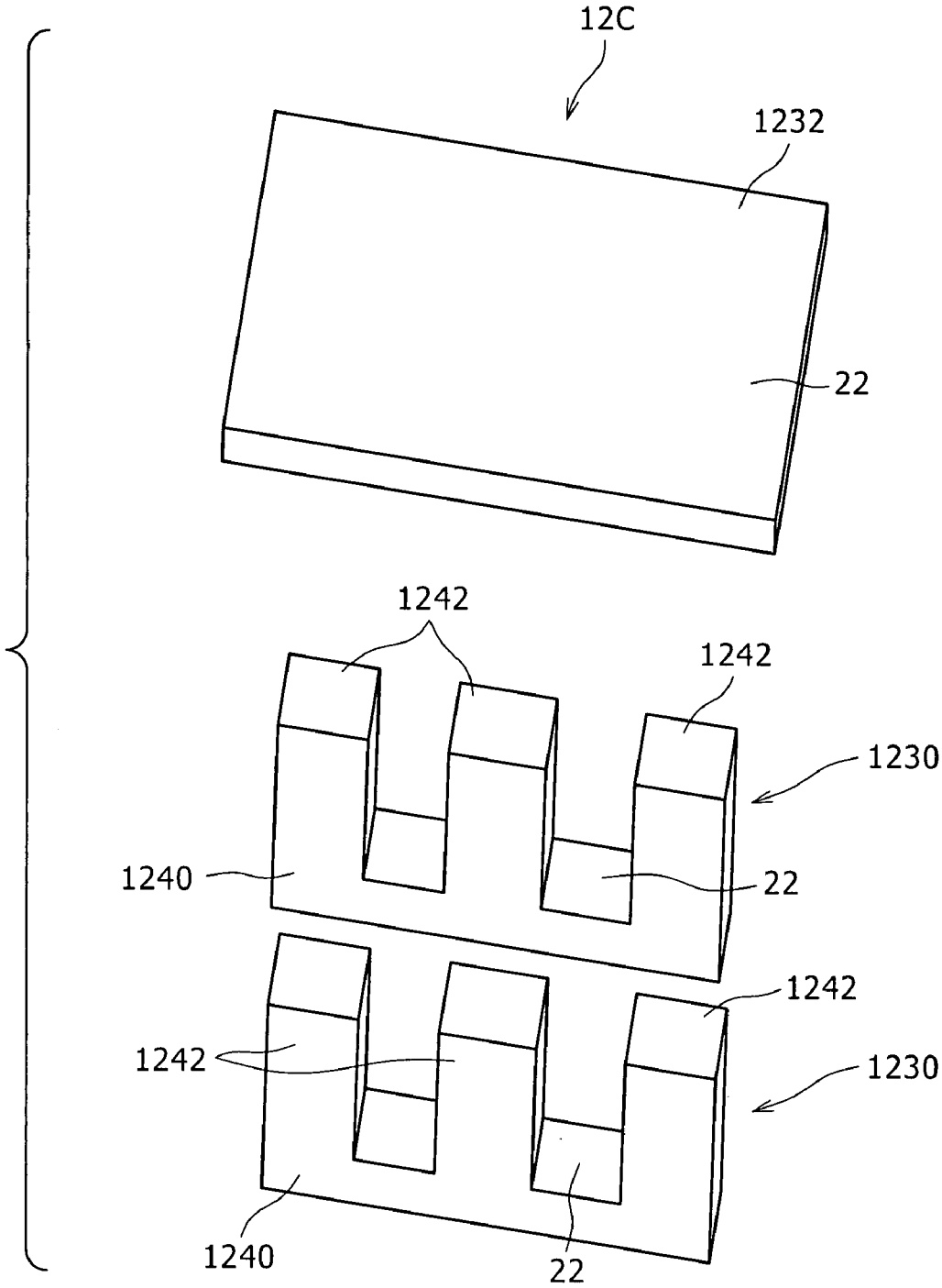
FIG. 10 is an exploded perspective view showing a structure of an iron core of the transformer according to the fifth embodiment.

FIG. 9 is a sectional view of a transformer 10 according to the fifth embodiment. FIG. 10 is an exploded perspective view showing a structure of an iron core 12C of the transformer 10 according to the fifth embodiment.

As shown in FIGS. 9 and 10, the iron core 12C in the transformer 10 according to the fifth embodiment has one output side iron core part 20, four input side iron core parts 18 situated in the vicinity of the output side iron core part 20, and a connecting iron core part 22 for connecting both ends in a direction of length of the four input side iron core parts 18 to both ends in a direction of length of the output side iron core part 20.

The four input side iron core parts 18 and the output side iron core part 20 are disposed in parallel with each other. The four input side iron core parts 18 are provided around the output side iron core part 20.

In the fifth embodiment, as shown in FIG. 10, the iron core 12C is formed by joining together two first divided bodies 1230 and a second divided body 1232.

Each of the first divided bodies 1230 is formed by a plate part 1240 and three column bodies 1242 that are erected from both ends and a center in an extending direction of an upper surface of the plate part 1240, have a rectangular shape in section, and have a same height.

The second divided body 1232 is formed in the shape of a rectangular plate having an outline that contains the six column bodies 1242 in a state of the two first divided bodies 1230 being arranged.

The iron core 12C is formed by arranging the plate parts 1240 of the two first divided bodies 1230 so as to be in parallel with each other and adjacent to each other and joining ends of the six column bodies 1242 to the second divided body 1232 such that the ends of the six column bodies 1242 are in contact with the second divided body 1232.

Thus, of the three column bodies 1242 of each of the first divided bodies 1230, two column bodies 1242 at both ends form two input side iron core parts 18, respectively. Thereby a total of four input side iron core parts 18 are provided.

Central column bodies 1242 of the two first divided bodies 1230 form the single output side iron core part 20.

The second divided body 1232 and the plate parts 1240 form the connecting iron core part 22.

As in the first embodiment, the iron core 12C is formed by a soft magnetic material.

The primary windings 14 are wound around the four input side iron core parts 18, respectively. The number of turns of each primary winding 14 is N1.

As in the first embodiment, both ends 1402 of each primary winding 14 are connected to input terminals 1002 of the transformer 10 in parallel with each other.

A secondary winding 16 is wound around the output side iron core part 20. The number of turns of the secondary winding 16 is N2.

As in the first embodiment, both ends 1602 of the secondary winding 16 are connected to output terminals 1004 of the transformer 10.

The action and effect of the transformer 10 will next be described.

When an input voltage V1 is supplied to the input terminals 1002, the four primary windings 14 generate independent magnetic fluxes $\phi 1$, $\phi 2$, $\phi 3$, and $\phi 4$ (generated magnetic fluxes $\phi 1$, $\phi 2$, $\phi 3$, and $\phi 4$) in the respective input side iron core parts 18, and these magnetic fluxes $\phi 1$, $\phi 2$, $\phi 3$, and $\phi 4$ pass through the output side iron core part 20 via the connecting iron core part 22, whereby a total of the magnetic fluxes $\phi 1$, $\phi 2$, $\phi 3$, and $\phi 4$ intersect the secondary winding 16. Thus an output voltage V2 of the secondary winding 16 is based on the magnetic flux $\phi 1+\phi 2+\phi 3+\phi 4$.

The output voltage V2 of the secondary winding 16 is proportional to an amount of magnetic flux intersecting the secondary winding 16. In the transformer 10 according to the fifth embodiment, since the four primary windings 14 whose number of turns is N1 are provided, the magnetic flux intersecting the secondary winding 16 is four times that of an existing transformer provided with one primary winding 14 whose number of turns is N1, and therefore an output voltage four times that of the existing transformer can be obtained. In other words, the number of turns of the secondary winding 16 can be reduced to ¼ of that of the existing transformer.

Hence, the transformer 10 according to the fifth embodiment has the action and effect of the first embodiment, of course, and with the four primary windings 14 and the four input side iron core parts 18, the transformer 10 according to the fifth embodiment is even more advantageous than the second embodiment in reducing size and cost while obtaining high voltage. In addition, since the number of turns of the secondary winding 16 can be further reduced, the transformer 10 according to the fifth embodiment is even more advantageous in improving electrical characteristics and securing reliability of the transformer 10.

It should be understood by those skilled in the art that various modifications, combinations, sub-combinations and alterations may occur depending on design requirements and other factors insofar as they are within the scope of the appended claims or the equivalents thereof.

What is claimed is:

1. A transformer comprising:

an iron core; and a winding wound around said iron core;

wherein said iron core includes a column-shaped output side iron core part, a plurality of column-shaped input side iron core parts situated in a vicinity of said output side iron core part, and a connecting iron core part configured to connect both ends in a direction of length of said plurality of input side iron core parts to both ends in a direction of length of said output side iron core part, said winding includes a plurality of primary windings respectively wound around said plurality of input side iron core parts, a secondary winding wound around said output side iron core part, and generated magnetic fluxes generated in said input side iron core parts by said primary windings, respectively, independently pass through said output side iron core part via said connecting iron core part, whereby a total of a plurality of said generated magnetic fluxes intersect said secondary winding.

2. The transformer as claimed in claim 1, wherein said input side iron core parts and said output side iron core part are arranged in parallel with each other.

3. The transformer as claimed in claim 1, wherein said input side iron core parts and said output side iron core part are arranged in parallel with each other, and are disposed in a shape of extending straight lines arranged in a direction orthogonal to the direction of length of said input side iron core parts and said output side iron core part.

4. The transformer as claimed in claim 1, wherein said plurality of input side iron core parts is disposed around said output side iron core part.

5. The transformer as claimed in claim 1, wherein said output side iron core part is formed by a plurality of column bodies, and said secondary winding is wound around said plurality of column bodies.

* * * * *